United States Patent [19]

Landsinger et al.

[11] 4,346,893

[45] Aug. 31, 1982

[54] REMOTE CONTROLLED SPORTS GAME

[75] Inventors: Edmund E. Landsinger, Torrance; Denis V. Bosley, Rancho Palos Verdes, both of Calif.

[73] Assignee: Mattel, Inc., Hawthorne, Calif.

[21] Appl. No.: 195,717

[22] Filed: Oct. 9, 1980

[51] Int. Cl.[3] ..... A63F 7/06; A63H 29/22; A63H 30/02

[52] U.S. Cl. ..... 273/85 F; 46/254; 46/248; 46/262; 273/85 G; 273/94

[58] Field of Search ..... 273/85 R, 85 G, 85 F, 273/94; 46/262, 210, 254, 213, 253, 212, 255, 256

[56] References Cited

U.S. PATENT DOCUMENTS

| | | | |
|---|---|---|---|
| 1,712,781 | 5/1929 | Williams | 273/94 R |
| 2,117,597 | 5/1938 | Berger | 46/213 X |
| 2,522,782 | 9/1950 | Glickman | 273/85 F |
| 3,672,674 | 6/1972 | Reed | 273/85 F X |
| 3,862,514 | 1/1975 | Veda | 46/210 X |
| 4,112,615 | 9/1978 | Ishimoto | 46/254 |
| 4,171,592 | 10/1979 | Saitoh | 46/262 X |
| 4,207,502 | 6/1980 | Omura | 46/254 X |

FOREIGN PATENT DOCUMENTS

| | | | |
|---|---|---|---|
| 1453964 | 1/1969 | Fed. Rep. of Germany | 273/85 F |
| 2049094 | 5/1971 | Fed. Rep. of Germany | 273/85 F |
| 2754036 | 2/1979 | Fed. Rep. of Germany | 46/254 |
| 2040708 | 9/1980 | United Kingdom | 273/85 F |

OTHER PUBLICATIONS

Schaper Toys Catalog, 1978, 3-1978, Super Jock Hockey, no. 696.

*Primary Examiner*—Paul E. Shapiro

*Attorney, Agent, or Firm*—John G. Mesaros; Max E. Shirk; Ronald M. Goldman

[57] ABSTRACT

A remote controlled sports game having first and second figures operable on a playing surface with each of the figures having receivers tuned to different frequencies for operation by radio transmitters with the control of movement of the figures against a game object such as a ball being effected remotely. A drive system is provided for driving two wheels simultaneously with reversal of direction of the motor operating a cam slide member through a spring clutch to lift one drive wheel for providing a tight turning radius.

14 Claims, 10 Drawing Figures

REMOTE CONTROLLED SPORTS GAME

BACKGROUND OF THE INVENTION

The background of the invention will be discussed in two parts:

1. Field of the Invention

This invention relates to remote controlled games and more particularly to a radio controlled sports game utilizing at least two independently controlled wheel driven sports figures.

2. Description of the Prior Art

Remotely controlled toy vehicles have become very popular and with the decreasing cost of electronics, low cost versions have been developed. One such remote control system for a toy vehicle is shown and described in U.S. Pat. No. 4,112,615 issued to Zenichi Ishimoto on Sept. 12, 1978. In accordance with the system of this patent, a carrier signal of a specific frequency is used to transmit to a receiving unit in the vehicle, the receiving unit normally generating a noise signal which is attenuated by the transmitted signal, the attenuated difference actuating a relay to reverse the polarity to a battery driven motor to permit operation of the vehicle in both the forward and reverse directions.

Another such radio controlled toy automobile is shown and described in U.S. Pat. No. 3,862,514 to Minoru Ueda on Jan. 28, 1975. As part of the drive mechanism, the front steering axle carries an idler wheel and a fixed motor driven wheel so constructed that when the signal from the transmitter is no longer received the vehicle body continues moving due to inertia but the drive wheel is stopped to thereby pivot the front steering axle so that the toy vehicle turns.

Another mechanism employed for changing the direction of a wheeled toy is shown and described in U.S. Pat. No. 4,034,504 issued to Shyohei Sudo on July 12, 1977. In the device shown in this patent, an electromagnet is employed for axially moving a rod into engagement with a recessed portion formed on the inner surface of the wheel to thereby stop the so-engaged wheel and cause turning movement.

Sporting games having articulated figures operable for simulating events are shown and described in U.S. Pat. No. 2,884,253 issued to J. Rivero-Ferro on Apr. 28, 1959 and U.S. Pat. No. 3,379,441 issued to F. G. Feather, et al on Apr. 23, 1968. In the first of these two patents, a simulated soccer game is illustrated in which a figure is mounted on a playing surface with a leg thereof pivotable relative thereto in response to actuating of an electromagnet to enable the foot to kick a ball. In the other of these two patents, a football game is simulated with players mounted on mobile carriers which are wheel driven by any suitable means with the object being to direct the carriers with the figures carried thereon into each other. In the embodiments illustrated, the source of power is a spring motor or a battery operated motor. The player figures have articulated members so that upon impact the torso portion of one of the figures is moved toward the other figure due to inertia or momentum.

It is an object of the present invention to provide a new and improved remotely controlled sports game.

It is another object of the present invention to provide a new and improved remotely controlled sports game employing at least two independently controlled wheel driven sporting figures configured for engaging a game object.

It is still another object of the present invention to provide a new and improved turning mechanism for wheel driven objects.

SUMMARY OF THE INVENTION

The foregoing and other objects of the invention are accomplished by providing first and second independently remotely controllable wheel driven sports figures configured for engaging a game object such as a ball or a puck for directing the game object toward a goal device. Each figure is provided with a radio signal receiver, a motor, a relay and a pair of drive wheels, each of which is secured to a common axle and suitably coupled for rotation by the motor. A cam slide member is freely mounted on the axle with a coil spring encircling the axle and interposed between the adjacent surface of the cam slide and the adjacent surface of the drive gear coupled to the axle. The lowermost surface of the cam slide is configured so that with the motor operating in the forward direction the cam surface is inoperative, and in the reverse direction of drive of the motor the spring clutch pivots the cam slide so that a surface thereof contacts the surface on which the figures operate to thereby lift the adjacent drive wheel from the group to permit movement of the figure about the point of contact in a tight turning radius to simulate evasive movement of the sports figure.

Other objects, features and advantages of the invention will become apparent from a reading of the specification when taken in conjunction with the drawings in which like reference numerals refer to like elements in the several views.

Figure 1:
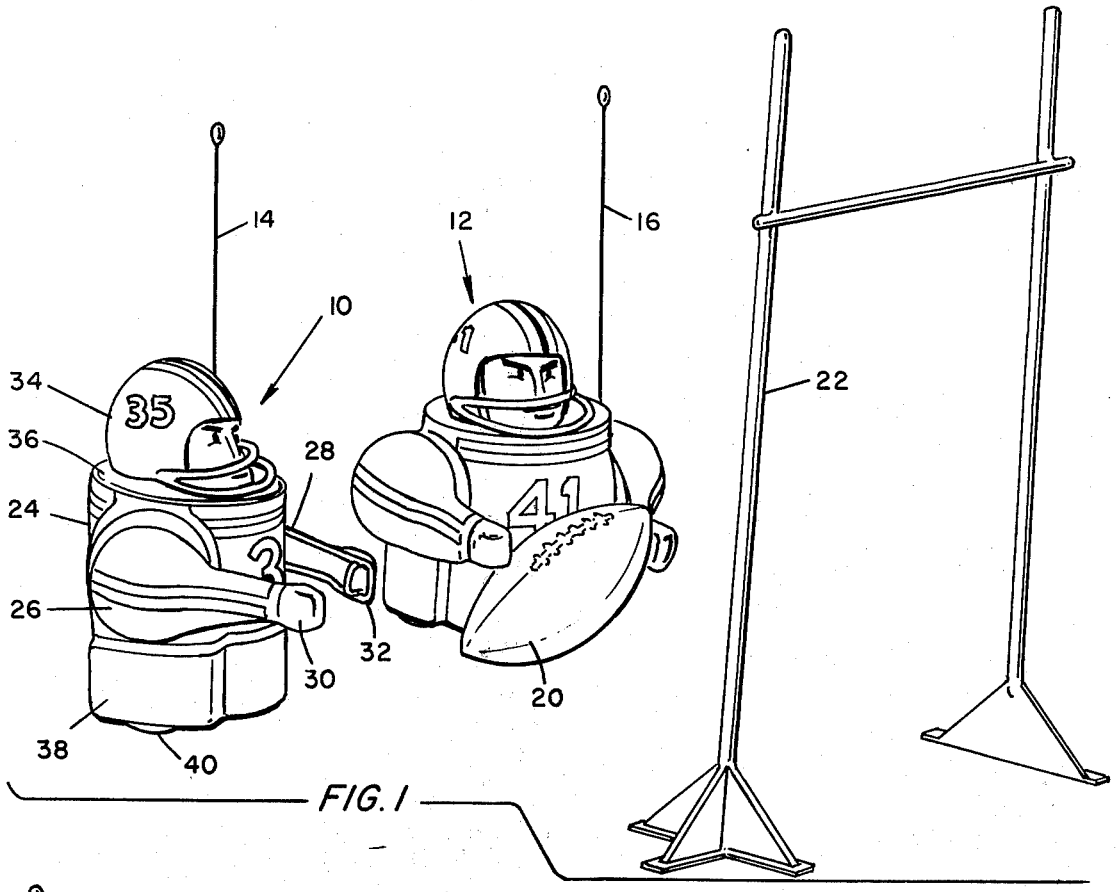
FIG. 1 is a perspective view of the remote controlled sports game according to the invention illustrating two figures, a game object such as a ball and a goal post.
Figure 2:
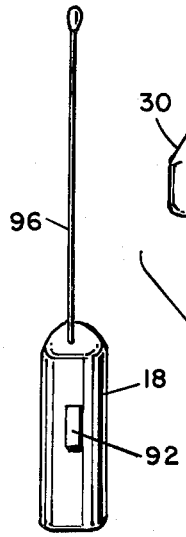
FIG. 2 is a perspective view of a radio controlled transmitter for use with the sports game of FIG. 1.
Figure 5:
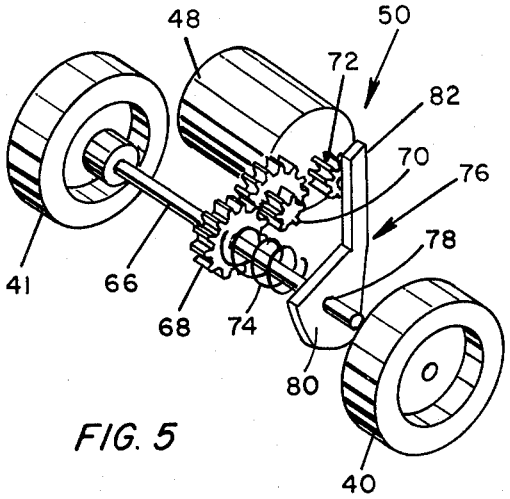
FIG. 5 is a perspective view of the main functional components of the drive mechanism utilized in the sports game of FIG. 1.
Figure 6:
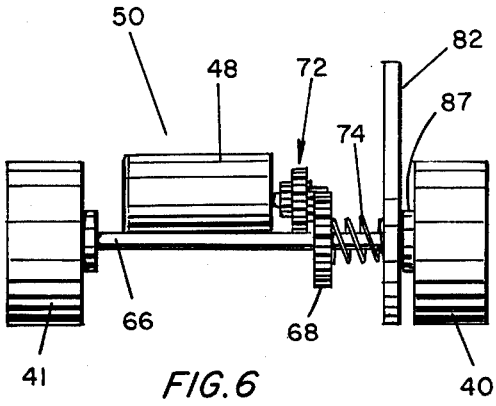
FIG. 6 is a front elevational view of the drive mechanism of FIG. 5.
Figure 8:
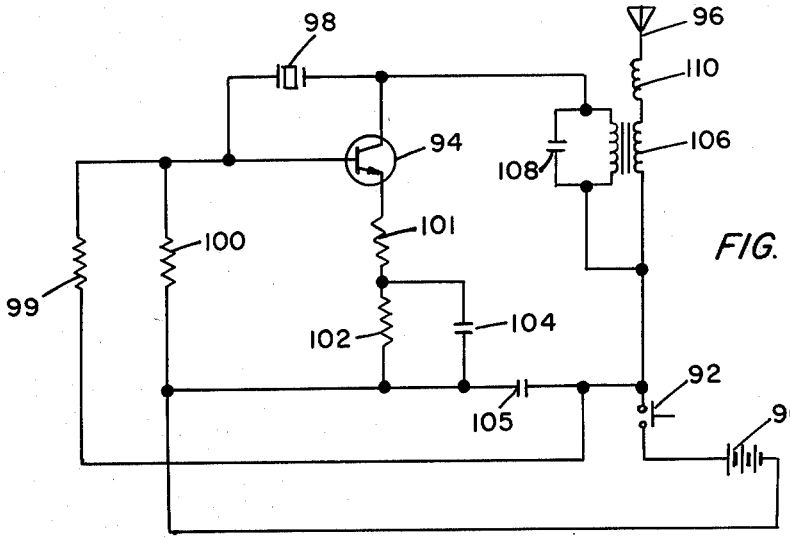
Figure 9:
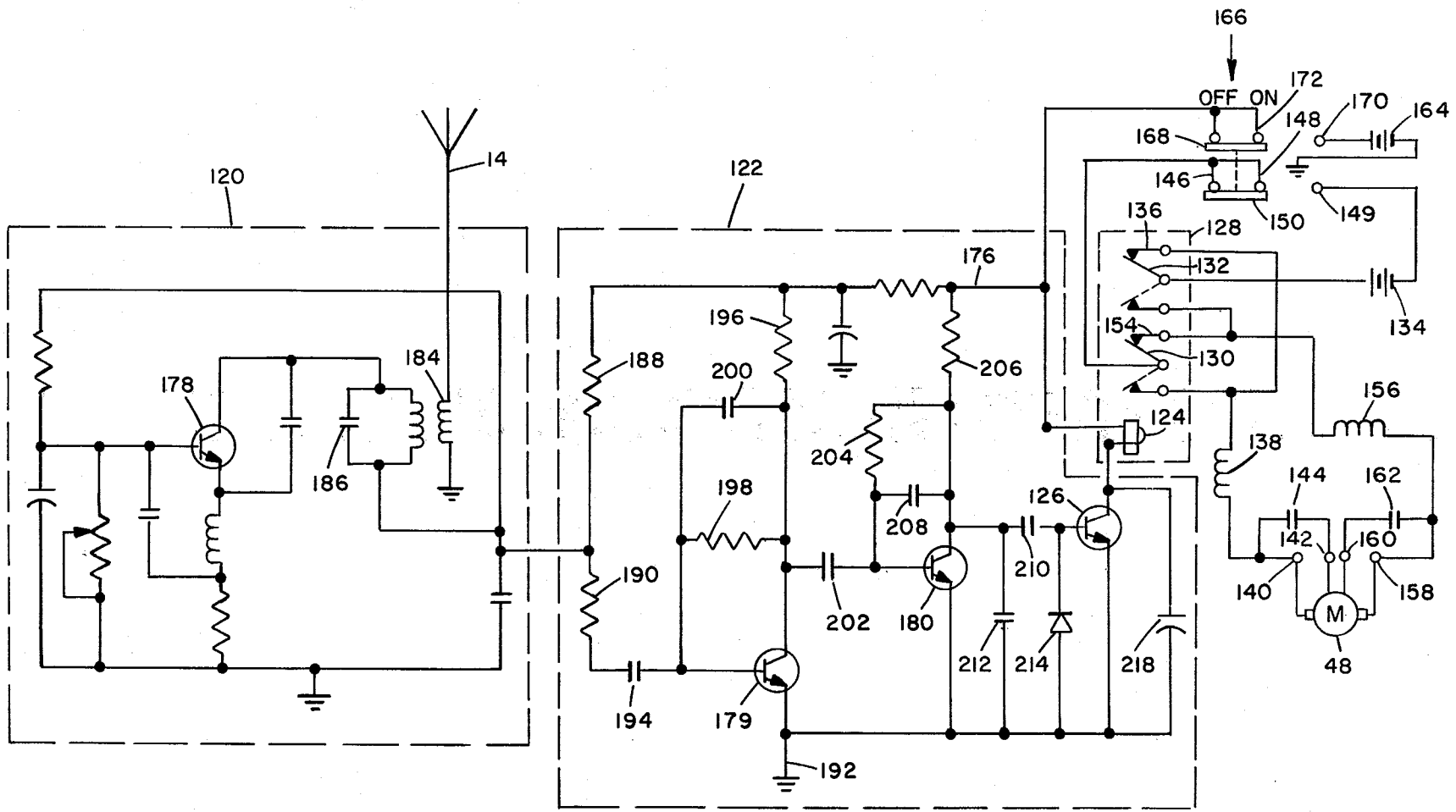

FIGS. *7a* and *7b* are diagramatic illustrations in side view of the cam slide operation of the drive mechanism of FIGS. 5 and 6;

FIG. 8 is a schematic diagram of the transmitter electronics within the transmitter housing of FIG. 2; and FIG. 9 is a schematic diagram of a receiver within one of the sports figures of FIG. 1.

DESCRIPTION OF THE PREFERRED EMBODIMENT

Referring now to the drawings and particularly to FIGS. 1 and 2, there is shown two sports figures, generally designated 10 and 12, each of which is provided with a radio signal receiving antenna 14 and 16 respectively, for receiving signals from two different radio transmitters, such as the transmitter 18 illustrated in FIG. 2. The sports figures 10 and 12 are configured for coacting with a game object such as a ball 20, with the ultimate purpose of the game, in the case of a football-type sports figure, being to manipulate the ball 20 between the goal posts 22. The sports figures 10 and 12 are each configured generally identically and may vary on the exterior appearance by changes in color or numbers or designate opposing sides. In any event, the sports figure 10 includes a generally cylindrical body 24 having pivotally affixed to opposing sides thereof adjacent the "shoulder" portions arm members 26 and 28, terminating in hand portions 30 and 32 respectively, the interiors of which are configured to receive game devices such as hockey sticks or the like to be described hereinafter. Removably mounted on the cylindrical body 24 is a head member 34 configured to simulate a football player with a helmet and nose guard. The head portion 34 may be integrally formed with a cover member 36 which closes the upper end of the cylindrical body 24, this cover 36 along with head member 34 being removable for access to the interior of the cylindrical body 24 for battery installation.

The cylindrical body 24 (referring also to FIG. 4) terminates in a downwardly depending skirt portion 38 which, is in close proximity to the ground or playing surface and spaced therefrom by a small portion of the tread of a drive wheel 40.

Figure 4:
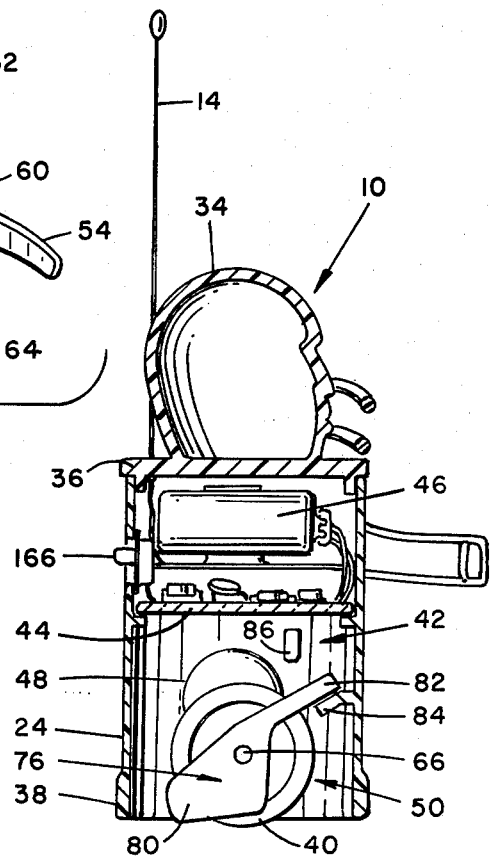
FIG. 4 is a partial cross-sectional view of one of the sports figures of FIG. 1 diagramatically illustrating the component layout therein.

As can be seen in FIG. 4, the interior 42 of the cylindrical body 24 is configured for receiving components and the drive mechanism therein, the components generally including a printed circuit electronic assembly generally designated 44 which may be mounted therein in any convenient manner. The upper portion of the interior 42 is essentially a battery compartment for receiving suitable batteries 46 for powering the electronic assembly 44 to ultimately drive a drive motor 48 of the drive mechanism generally designated 50 in the lower portion of the interior 42. Details of the mechanism will be described hereinafter.

Referring again to FIGS. 1 and 3, the arms 26 and 28 of the figure 10 (and also the arms of the sports figure 12) are spaced apart and pivotable. The cylindrical body 24 is configured to provide a broad diameter of low center of gravity for stability when utilizing a single pair of drive wheels 40. The game object of football 20 is dimensioned for impacting with the cylindrical body 24, preferably between the hand portions 30 and 32 of the arms 26 and 28 so that remote controlled operation of the sports figures 10 and 12 provide a means of ultimately controlling the direction of movement of the ball 20 toward the goal posts 22. To enhance the skill and amusement of the participants in the game, as will hereinafter be described, each of the sports figures 10 and 12 is wheel driven and independently remotely controllable by suitable transmitters 18 with the forward direction of travel being generally in a straight line with a reverse direction of travel being provided for quickly turning each of the figures 10 and 12 for directional control. The turning mechanism which is part of the drive mechanism, in the reverse direction of the motor 48 lifts one of the drive wheels 40 to provide a tight turning radius in the reverse direction. This construction will be described in detail hereinafter.

Figure 3:
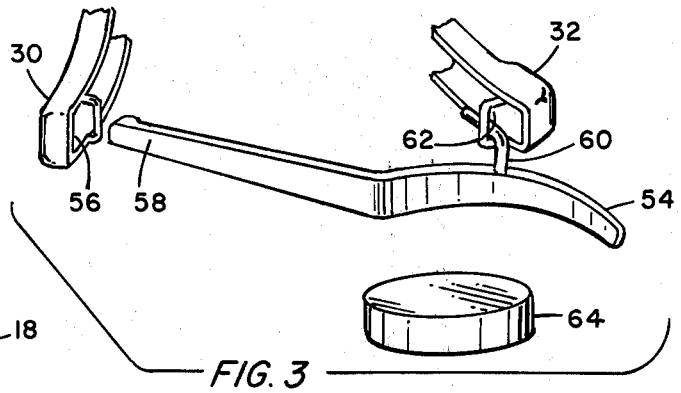
FIG. 3 is an enlarged perspective view of the hand portions of the figures of FIG. 1 grasping a game device such as a hockey stick for use with the puck.

Referring briefly to FIG. 3, each of the sports figures 10 and 12 can be suitably configured to simulate a hockey player which requires a game device such as a hockey stick 54. For enabling the hands 30 and 32 to retain the hockey stick 54, the hand 30 is provided with an indentation or recess 56 configured by suitably forming the hand 30, the recess 56 being configured for receiving the end 58 of the hockey stick 54 for retention therein. In proximate location to the other hand 32, the hockey stick 54 is provided with an upwardly extending generally inverted L-shaped handle member 60 which may be inserted into an opening 62 suitably formed in the hand 32. With the arms 26 and 28 being pivotable, the arms may be pivoted until the lower edge of the hockey stick 54 is in proximity to the surface on which the sports figures 10 and 12 are driven. The simulated hockey stick 54 is also provided with an arcuate or curved edge for engaging a second game object or puck 64 for enabling the simulation of a hockey contest. With such a sports game, the simulated goal post 22 will be replaced by a simulated hockey net (not shown).

Referring now to FIGS. 4 through 7, the details pertaining to the drive mechanism 50 will now be described. As can be seen in FIG. 4, the drive mechanism 50 is positioned within the interior 42 of the cylindrical body 24 so that the axle 66 is above the plane of the lower edge of the depending skirt 38 of the body 24 with the depending drive wheel 40 extending below this plane a slight distance. In the forward or reverse direction of travel, the depending skirt 38 will have the leading or trailing edge thereof in sliding relation with the surface on which the sports figure 10 is driven. With the use of two drive wheels 40 and 41 (see FIG. 5) both fixed to the same axle 66, forward or reverse direction of travel of the sports figure 10 will result in a slight amount of rocking of the body 24 as the direction changes, this rocking effect providing a certain amount of action to the game to simulate rapid movements of actual sports figures.

In FIG. 5, the drive mechanism generally designated 50 is illustrated in partially disassembled relation with one drive wheel 40 removed from the axle 66. Secured to the axle 66 is a drive gear 68 which coacts with a suitable gear train 70 to be driven from the pinion 72 of the electrical motor 48. A coil spring 74 encircles the axle 66 with one face of the coil spring 74 having the end thereof secured to or at least in engagement with the adjacent face of the drive gear 68. The opposite end of the coil spring 74 abuts against a cam slide member generally designated 76, the cam slide member being provided with an aperture 78 in the main body cam portion thereof, the aperture 78 being slightly greater than the diameter of the axle 66 for loosely fitting thereon. The cam slide member is provided with an upwardly extending arm portion 82 which coacts with one of two stop members fixedly positioned relative to the interior 42 of the cylindrical body 24. As shown in FIG. 4, the arm portion 82 fits between the stop members 84 and 86 which limit the amount of pivoting of the cam slide member 76.

Referring now to FIG. 6, the drive mechanism 50 is shown in its assembled condition. As assembled, the drive wheel 40 is provided with a boss portion 84 which has a generally planar surface in abutting relation with the cam portion 80 of the cam slide 76, the opposite surface of cam portion 80 urging against the adjacent edge of the coil spring 74 to place the coil spring 74 in a slightly compressive state. The other edge of coil spring 74 is in abutting relation with the adjacent face of the drive gear 68 which is affixed to the axle 66 for concurrent rotation therewith. Both drive wheels 40 and 41 are secured to opposite ends of the axle 66 for concurrent rotation therewith.

Figure 7A:
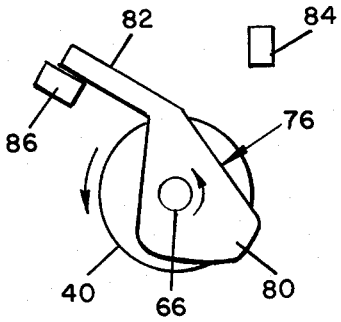
Figure 7B:
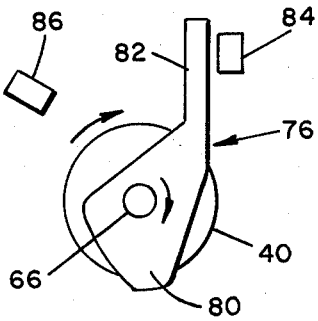

Referring also to FIGS. 7*a* and 7*b*, the operation of the cam slide member 76 will be described. These figures are diagramatic representations eliminating other components not necessary to an understanding of the operation and, with reference to FIG. 6, the diagram would be as viewed from left to right. FIG. 7*a* depicts the forward direction of travel in which the wheel 41 is rotating in the direction as indicated by the arrow adjacent thereto and the toy figure is moving in the direction of the arrow thereunder. In this direction of travel, the adjacent face of the coil spring 74 is urging the cam slide member 76 for pivoting in the direction indicated by the arrow adjacent the axle 66 (counterclockwise) with the arm portion 82 pivoting until limited by the fixed position of the stop 86. In this position of the cam slide member 76, the configuration of the edge of the cam portion 80 is such that the downward dimension from the center of the axle 66 is less than the radius of the wheel 41. Thus, the cam portion 80 is out of engagement with the surface on which the wheel 41 is traveling to permit both drive wheels 40 and 41 to engage the surface.

Referring to FIG. 7*b*, in the reverse direction of travel the wheel 41 will be rotating in the clockwise direction as indicated by the arrow adjacent thereto, thus pivoting the cam slide member 76 in the clockwise direction until the arm portion 82 thereof coacts with the limiting means or stop 84. At this position of pivoting of the cam slide member 82, the dimension of the cam portion 80 from the center of the axle 66 downwardly to the contacted surface is greater than the radius of the wheel 40, thus lifting the adjacent wheel from the surface by the difference in dimension. The dimension is approximately one-eigth of an inch of lift of the drive wheel 40 so then in the reverse direction of travel of the motor 48, the sports figure 10 is pivoting about the point of contact of the lower edge of the cam portion 80 with the surface. To facilitate the limited pivotal movement of the cam slide member 76, the coil spring 74 is preferably placed on the axle 66 with the helix thereof in the direction conducive to sliding over the adjacent surface of the cam slide 76 in the forward direction while frictionally engaging this surface in the reverse direction of travel. The drive mechanism 50 as constructed is compact and efficient and utilizes a minimum number of components to provide effective steering of a remotely controlled toy. In actual practice, the reverse direction of operation of the motor 48 and the slide member 82 is to provide rapid efficient steering rather than prolong reverse directions of travel.

Referring now to FIGS. 8 and 9 the electronic portion of the game will be described. FIG. 8 is a schematic diagram of the transmitter of FIG. 2 which is provided with a suitable source of power such as a battery 90 operabe through a switch 92 to energize a transistor 94 for transmitting a signal through the antenna 96. The transmitter of FIG. 8 is conventional and essentially includes a transistor 94 coupled for oscillation at a frequency determined by a crystal oscillator 98 with suitable biasing for transistor 94 being provided by resistors 99–102 and capacitors 104 and 105. A tuned circuit is provided in circuit relation between the collector and emitter of transistor 94 by means of a transformer 106 having its primary in parallel with a capacitor 108 and its secondary coupled in series relation through an inductor 110 to the antenna 96. In the actual game, it is to be understood that two transmitters will be provided with each transmitter being tuned to a different operating frequency for providing radio signals to the receivers of the sports figures 10 and 12, each of which is tuned for receiving one of the two selected frequencies. Thus, the sports figures 10 and 12 will be independently controllable by two participants. Operation of each of the transmitters will be by virtue of depression of the switch 92 which applies the power required to the transmitter 94 to provide the oscillations for the transmission of the predetermined frequency radio signal from the antenna 96.

Referring now to FIG. 10, there is shown a schematic diagram of the receiver employed in the game according to the invention. The receiver's circuitry basically includes a receiver section 120 (shown in dotted lines) and a control section 122 (shown in dotted lines) with the coil 124 of a relay connected in circuit relation with the output transistor 126 of the control section 122. The relay 128 is shown in dotted lines and includes the coil 124 along with two poles 130 and 132 movable simultaneously from a first normal position to an energized position. Actuation of the relay 128 results in the reversing of the polarity of the power source to the motor shown diagramatically with reference numeral 48.

The relay 128 is essentially a double pole double throw relay shown in the diagram in its normally inoperative position with the pole 132 completing a circuit from the positive terminal of a first power source or battery 134 over contact 136 to a first inductor 138 to a first lead 140 of the motor 48. The terminal 140 is coupled to a second terminal 142 of the motor 48 by a series capacitor 144.

In this condition of the relay 128, the other pole 130 is in circuit relation with a pair of terminals 146 and 148 engaged by a movable contact 150 configured for completing the circuit to the negative terminal of the battery 134. The pole 130 is shown in electrical relation with the contact 154 of the relay 128 which is connected in series relation through a second coil or inductor 156 to a third terminal 158 of the battery 48. A second capacitor 162 is coupled between the terminal 158 and a fourth terminal 160 of the motor 48.

A second power source or battery 164 provides the power for the transistors of the receiver section 120 and control section 122 with the on/off switch 166 being a double pole double throw switch which simultaneously places both batteries 134 and 164 in circuit relation with the components of the receiver. With the switch 166 in the "on" position, the movable slide contact 168 will bridge the gap between terminals 170 and 172 while simultaneously slide contact 150 bridges the gap between terminals 148 and 149, thus placing both batteries 164 and 134 in circuit relation with the balance of the circuitry. By way of example, the battery 134 may be 4.5 volts with a higher current rating while the battery 164 may be 9 volts for energizing transistors. With the switch 166 "on" a positive voltage is applied from battery 164 over lead 176 for providing an initial bias to transistors 178, 179, 180 and 126. Each of these transistors is an NPN transistor with transistor 178 being initially biased at a quiescent level.

Transistors 179, 180 and 126 essentially comprise a power amplifier section operable in response to receipt of an incoming signal of the proper frequency at antenna 14 (for controlling one of the sports figures 10).

The receiver section 120 is conventional and includes a transistor 178 suitably biased as an RF stage of a radio receiver for responding to the appropriate incoming frequency at the antenna 14 determined by the tuned circuit in the collector path of transistor 178, the tuned circuit including the inductance of transformer 184 and the value of capacitor 186. The selection of the resistors, capacitors and inductors of the receiver section 120 are determined by the frequency of the incoming radio signal at antenna 14 to which the receiver section 120 responds. Upon receipt of the radio signal of the proper frequency, the output of the receiver section 120 is transmitted over lead 186 to a voltage divider including resistors 188 and 190 connected in series circuit relation between the positive source of bias from battery 164 and ground 192. A radio frequency bypass capacitor 194 is provided in series circuit relation with the voltage divider to provide response only to radio signals within the range of capacitor 194 the end of which is coupled to the base of a first transistor 179, the emitter of which is coupled to ground 192. Resistors 196 and 198 along with capacitor 200 provide the appropriate biasing for the transistor 179. The output of transistor 179 is provided from the collector through a bypass capacitor 202 to the base of the second transistor 180 which is connected in common emitter configuration with biasing being provided by resistors 204 and 206 along with capacitor 208. The circuit configuration of transistors 179 and 180 provide two stages of amplification of the incoming signal received on lead 186 from the receiver section 120.

The output of transistor 180 is provided through a capacitor 210 to the base of the power transistor 126 with a second capacitor 212 being connected between the collector and emitter of transistor 180 and a clamping diode 214 being connected between the base and emitter of transistor 126. The coil 124 of the relay 128 is connected in series circuit relation between the collector of transistor 126 and the positive source of voltage appearing on lead 176 from the battery 164 with the switch 166 in the "on" position. A capacitor 218 connected between the collector on transistor 126 and ground 192 protects against current surges in the coil 124 while permitting the discharge to ground with the coil 124 de-energized.

In operation, the battery 164 provides power for the transistors as well as selective power to the coil 124 in series circuit relation with the collector-emitter path of transistor 126 when conducting. The battery source 134 is essentially for motor operation. With the switch 166 in the "on" position, and with no incoming radio signal, the current passing from battery 134 passes through the pole 132 through the stationary contact 136 through the inductor 138 to be applied to terminal 140 of the motor 48 with capacitor 144 protecting the motor 48 against current surges while providing a discharge path for the inductor 138. The terminal 158 of motor 48 passes through the inductor 156 through the stationary contact 154 of relay 128 through pole 130 to the negative side of battery 134 to thereby immediately provide a forward direction of travel of one of the toy figures 10 or 12. For a given sports figure, with the depression of the switch 92 of the transmitter 18 (see FIGS. 2 and 8) the antenna 96 of the transmitter 18 will provide a radio frequency signal for the time duration of the depression of switch 92. This signal will be received by the antenna 14 causing the transistor 178 with its appropriate components to oscillate to provide a radio frequency signal over lead 186 to the base of transistor 179 which then passes this radio signal, amplified, to the base of transistor 180 which further amplifies this radio signal and applies it to the base of transistor 126, this amplified signal being smoothed by capacitors 212 and 218 along with diode 214 to provide an approximately steady state current through relay coil 124 to thereby actuate poles 132 and 130 of relay 128 to the dotted line positions. In the dotted line positions, without a detailed explanation, the positive side of battery 134 is then applied to terminal 158 of motor 48 with the terminal 140 essentially being coupled to ground, thereby reversing the polarity of the motor 48 causing a reverse direction of travel of the appropriate toy sports figure 10 or 12 which reverse direction of travel causes the cam slide 76 to actuate to lift one of the drive wheels from the ground as previously discussed in conjunction with FIGS. 5 through 7. This reverse direction of travel is required only for a time duration necessary to orient the sports figure 10 or 12 in the direction desired by the operator with the drain on battery 164 thus being minimized since the coil 124 of relay 128 will only be active and drawing current when the button 92 of the transmitter 18 is depressed for providing this reverse movement.

With remotely controlled sports game as shown and described, each player is provided with a transmitter 18 which two transmitters operate on different frequencies with the sports figures 10 and 12 having receivers therein each responsive to one of the two frequencies. The figures 10 and 12 can then be placed on an appropriate surface with the scoring device or goal posts 22 at a predetermined location and the game object or ball 20 on the surface. For example, each of the toy figures 10 and 12 may be placed on one end of a table with the goal post 22 adjacent the other end with the ball 20 at a point intermediate. Upon starting, each player would then appropriately control his respective sports figure 10 or 12 after turning on the switch 166 of the figure. Upon turning on the switch 166, the sports figure 10 or 12 will immediately commence traveling in the forward direction and with adept manipulation of the switch 92 of the transmitter 18, steering may be readily effected to control the movement of the sports figure 10 or 12 toward the game object or ball 20. With the ball 20 shaped like a football, an additional dimension is provided due to the normally erratic movement of a football 20 rolling on a surface due to the oblong shape. The remotely controlled figures 10 and 12 may be directed toward each other for impact or toward the ball 20. Due to the extending arms 26 and 28, upon contact of one sports figure with another, a quick reversal of the motor could result in one player being able to spin the other by contact of one arm with the arm of the other figure thus requiring more skill for operation. In accordance with the general rules of football, a score may be effected when the ball 20 passes through the uprights of the goal post 22.

Correspondingly, if the hockey stick 54 and puck 64 are utilized with a simulated net, a certain amount of predictability enters the game due to the uniform configuration of the puck 64 which simply slides over the surface. However, with the steering capability of the sports figures 10 and 12, rapid movements of the puck 64 may be effected by reversing the direction of one of the toy figures 10 and 12 with the puck 64 in appropriate position relative to the hockey stick 54 to thereby provide a sharp impact of the hockey stick 54 with the puck 64. While there has been shown and described a preferred embodiment, it is to be understood that various other adaptations and modifications may be made within the spirit and scope of the invention. The sports figures 10 and 12 may be configured as soccer players with the game object or ball 20 being configured as a soccer ball with a simulated net being the game objective.

We claim:

1. In a remotely controlled sports game, the combination comprising:

first and second figures, each of said figures having motor means and radio signal receiving means of different operating frequencies, said receiving means including a manually operable switch for energizing said motor means in a first direction and for driving said motor means in the reverse direction in response to a received radio signal;

first and second radio signal transmitting means, each of said transmitting means having an operating frequency corresponding to the operating frequency of the receiving means of one of said figures;

drive means within each of said figures operable in response to actuation of the transmitting means associated therewith for manipulating said figures on a surface, said drive means including a pair of drive wheels coupled to a common axle and operable through said motor means, with means pivotally coupled to said common axle in proximity to one of said drive wheels and pivoted in response to the reverse direction of operation of said motor means for contacting the surface and for lifting the proximate drive wheel from the surface for pivoting said figure about the point of contact for the timed duration of the received radio signal;

game object means having a configuration for being manipulated on a surface upon impact with said figures in response to manipulation thereof by an operator; and game goal means configured for positioning on a surface for enabling the operator to direct said game object means toward said goal means for effecting scoring.

2. The combination according to claim 1 wherein said means pivotally coupled to said common axle includes a member having a cam surface with a first portion normally out of engagement with the surface and a second portion contacting the surface in response to pivoting of said member.

3. The combination according to claim 2 wherein said pivotable member includes an arm portion and each of said figures include stop means therein for limiting the angle of pivoting of said member.

4. The combination according to claim 3 wherein said drive means further includes a gear member fixedly coupled to said common axle and spring clutch means operatively coupled between said gear member and said pivotable member.

5. The combination according to claim 4 wherein said spring clutch means includes a coil spring encircling said axle and interposed between said gear member and the facing surface of said pivotable member.

6. The combination according to claim 1 wherein each of said figures further includes a pair of arm members pivotally coupled to said body member, said game object means is a ball and said arm members are pivotable to a position for enabling directional control of said ball.

7. The combination according to claim 6 wherein each of said arm members includes a hand portion, said game further includes a game device configured for engagement with said game object means and said hand portions are configured for receiving said game device.

8. The combination according to claim 7 wherein said game device is a simulated hockey stick and said game object means is a simulated hocky puck.

9. The combination according to claim 6 wherein said ball is configured in the form of a football and said game goal means is a simulated goal post.

10. In a drive mechanism for a motor controlled toy, the combination comprising:

motor means within said toy;

a pair of drive wheels coupled to a common axle and configured for contacting a surface for moving said toy;

means interconnecting said motor means and said common axle for driving said drive wheels in a first direction of travel with a first direction of rotation of said motor means;

means pivotably coupled to said axle in proximate relation to one of said drive wheels and configured for being pivoted in a first direction during the first direction of travel of said drive wheels; and means for pivoting said means pivotably coupled to said axle in a second direction in response to rotation of said drive wheels in a reverse direction, said pivotable means being configured for contacting the surface and for lifting the proximate drive wheel from the surface for enabling pivoting of the drive wheel assembly about the point of contact for effecting steering.

11. The combination according to claim 10 wherein said means pivotably mounted to said axle is a member having a cam surface with a first portion normally out of engagement with the surface and a second portion for contacting the surface in response to pivoting thereof in the second direction.

12. The combination according to claim 11 wherein said pivotable member includes an arm portion and stop means within said toy for limiting the angle of pivoting of said member.

13. The combination according to claim 12 wherein said means interconnecting said motor means and said axle include a gear member affixed to said axle and said means for enabling pivoting of said pivotable member includes spring clutch means on said axle between said gear member and said pivotable member.

14. The combination according to claim 13 wherein said spring clutch means includes a coil spring encircling said axle intermediate said gear member and said pivotable member and engaging the adjacent surfaces thereof.

* * * * *